US005234391A

United States Patent [19]

Shasek et al.

[11] Patent Number: 5,234,391

[45] Date of Patent: * Aug. 10, 1993

[54] WATER EXERCISE APPARATUS

[75] Inventors: Judy Shasek, Hollywood, Fla.; Leonard Schwartz, 5526 Northumberland St., Pittsburgh, Pa. 15217

[73] Assignee: Leonard Schwartz, Pittsburgh, Pa.

[ * ] Notice: The portion of the term of this patent subsequent to Jun. 12, 2007 has been disclaimed.

[21] Appl. No.: 775,916

[22] Filed: Oct. 15, 1991

Related U.S. Application Data

[63] Continuation of Ser. No. 579,095, Sep. 5, 1990, abandoned, which is a continuation of Ser. No. 288,762, Dec. 22, 1988, abandoned, which is a continuation of Ser. No. 100,951, Sep. 25, 1987, Pat. No. 4,932,653.

[51] Int. Cl.[5] ..... A63B 3/00; A63B 21/008; A63B 21/068

[52] U.S. Cl. ..... 482/111; 482/96; 482/42

[58] Field of Search ..... 272/93, 62, 63, 120, 272/DIG. 4, 144; 248/165, 423; 482/42, 121, 130, 111, 96

[56] References Cited

U.S. PATENT DOCUMENTS

| | | | |
|---|---|---|---|
| 775,718 | 11/1904 | Bitter | 482/42 |
| 3,112,928 | 12/1963 | Oswald | 272/71 |
| 3,707,285 | 12/1972 | Martin | 272/63 |
| 3,709,487 | 1/1973 | Walker | 482/130 |
| 4,503,845 | 3/1985 | Licciardi | 272/63 |
| 4,720,100 | 1/1988 | Du Buy | 482/121 |
| 4,875,673 | 10/1989 | Erickson | 272/71 |
| 4,927,138 | 5/1990 | Ferrari | 272/DIG. 9 |
| 4,932,653 | 6/1990 | Schwartz et al. | 272/62 |

*Primary Examiner*—Stephen R. Crow
*Attorney, Agent, or Firm*—Ansel M. Schwartz

[57] ABSTRACT

The present invention pertains to an apparatus for exercising. The exercise apparatus includes a first horizontal member having a free end and a second horizontal member also having a free end in spatial relationship to the first horizontal member. A freestanding platform supports the first horizontal member and the second horizontal member. The platform has a first vertical axis which extends through a first location where the first horizontal member is supported by the platform, and a second vertical axis extending through a second location where the second horizontal member is supported by the platform. The platform also defines an open region which extends between the first and second horizontal members. There is also a body of water having a bottom on which the platform is disposed such that at least a portion of the user is buoyantly supported during exercise. Preferably, there is also included structure for attaching the first horizontal member and the second horizontal member to the platform such that the first and second horizontal members are each able to be fixedly adjusted with respect to height, and the first and second horizontal members are each able to rotate about the first vertical axis and the second vertical axis, respectively. Preferably, a horizontal cross member is disposed anteriorly to the first and second members and essentially perpendicular thereto. The cross member is supported by the platform. The open region is disposed below the cross member.

3 Claims, 3 Drawing Sheets

WATER EXERCISE APPARATUS

This is a continuation application of 07/579,095 filed Sep. 5, 1990, (abandoned) which is a continuation application of 07/288,762 filed Dec. 22, 1988 (abandoned) which is a continuation application of 07/100,951 filed Sep. 25, 1987, now U.S. Pat. No. 4,932,653.

FIELD OF THE INVENTION

The present invention relates to exercise equipment. More specifically, the present invention relates to exercise equipment that is disposed in water and is capable of coupling the development of strength and aerobic capacity throughout the human body.

BACKGROUND OF THE INVENTION

There are a multitude of exercising apparatuses that are designed to use the exerciser's body weight as the primary source of resistance. Various exercises can be performed such as push-ups, pull-ups, and "running in place" while supported by the arms. Such exercises have an inherent drawback in that the exerciser cannot alter his own body weight. Therefore, many people do not have the strength to do the necessary number of repetitions that would benefit the cardiovascular system. Further, the effects of gravity can cause undue stress on various ligaments and connecting tissue.

There is a usefulness for an exercising apparatus that permits physical training of the body simultaneously for strength and aerobic activity wherein the user's bodyweight can be appropriately supported at various positions throughout the exercise movement. The present invention provides an exercising apparatus that is disposed in water so that the exerciser is buoyantly supported during exercise.

SUMMARY OF THE INVENTION

The present invention provides for the ability to concurrently develop strength and aerobic capacity while being buoyantly supported within water. The present invention utilizes a first horizontal member and a second horizontal member which are supported by a platform to enable a user to accomplish a wide range of exercises to develop various muscle groups in the body while experiencing an aerobic level of exercise. Preferably, the first and second horizontal members are able to rotate about a first and second vertical axis, respectively, and to be adjusted with respect to height, and there is a horizontal cross member disposed above the first and second horizontal members to maximize the effects and ranges of the exercises. The invention is a simple apparatus that makes for the execution of a variety of combined movements of the arms, legs and trunk of the human body in water.

The present invention pertains to an apparatus for exercising. The exercise apparatus is comprised of a first horizontal member having a free end and a second horizontal member also having a free end in spatial relationship to the first horizontal member. A freestanding platform supports the first horizontal member and the second horizontal member. The platform has a first vertical axis which extends through a first location where the first horizontal member is supported by the platform, and a second vertical axis extending through a second location where the second horizontal member is supported by the platform. The platform also defines an open region which extends between the first and second horizontal members. There is also a body of water having a bottom on which the platform is disposed such that at least a portion of the user is buoyantly supported during exercise. Preferably, there is also included means for attaching the first horizontal member and the second horizontal member to the platform such that the first and second horizontal members are each able to be fixedly adjusted with respect to height, and the first and second horizontal members are each able to rotate about the first vertical axis and the second vertical axis, respectively. Preferably, a horizontal cross member is disposed anteriorly to the first and second members and essentially perpendicular thereto. The cross member is supported by the platform. The open region is disposed below the cross member. Preferably, there are means for attaching the cross member to the platform such that the cross member can be fixedly adjusted with respect to height.

In a preferred embodiment, the first and second horizontal members and the horizontal cross member are tubular and hollow. Additionally, the first and second horizontal tubular members have a free end and a handle disposed thereon for gripping each horizontal tubular member, and the horizontal tubular cross member is able to support at least 250 pounds.

In a more preferred embodiment, the platform has a first and second post extending vertically therefrom for supporting the first and second horizontal members, respectively. The first and second posts are parallel and disposed opposite to each other with the open region therebetween. The first vertical axis is defined by the first post, and the second vertical axis is defined by the second post. Furthermore, the platform has a third and fourth post extending vertically therefrom for supporting the horizontal cross member. The third post is parallel to the first post and adjacent thereto, and the fourth post is parallel to the second post and adjacent thereto. The third and fourth posts are disposed opposite to each other with the open region therebetween.

In an even more preferred embodiment, the means for attaching the first and second horizontal members include a first and second means for attaching the first horizontal member and the second horizontal member, respectively, to the first and second posts, respectively, such that the first and second horizontal members are each able to be fixedly adjusted with respect to height, and the first horizontal member is able to rotate about the first vertical axis and the second horizontal member is able to rotate about the second vertical axis. Moreover, the means for attaching the horizontal cross member to the platform includes a third and fourth attaching means for attaching the horizontal cross member to the third and fourth posts, respectively, such that the horizontal cross member is able to be fixedly adjusted with respect to height. The first, second, third and fourth posts are hollow and the first and second horizontal members each have a flanged end such that the flanged end of the first horizontal member fits into the hollow first post through the first attaching means, and the flanged end of the second horizontal member fits into the hollow second post through the second attaching means. The horizontal cross member has a first and second flanged end such that the first and second flanged ends of the horizontal cross member fit into the hollow third and fourth posts, respectively, through the third and fourth attaching means, respectively.

In a preferred embodiment, the platform is not freestanding but is fixedly attached to the bottom of the body of water, preferably with two fixture elements.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
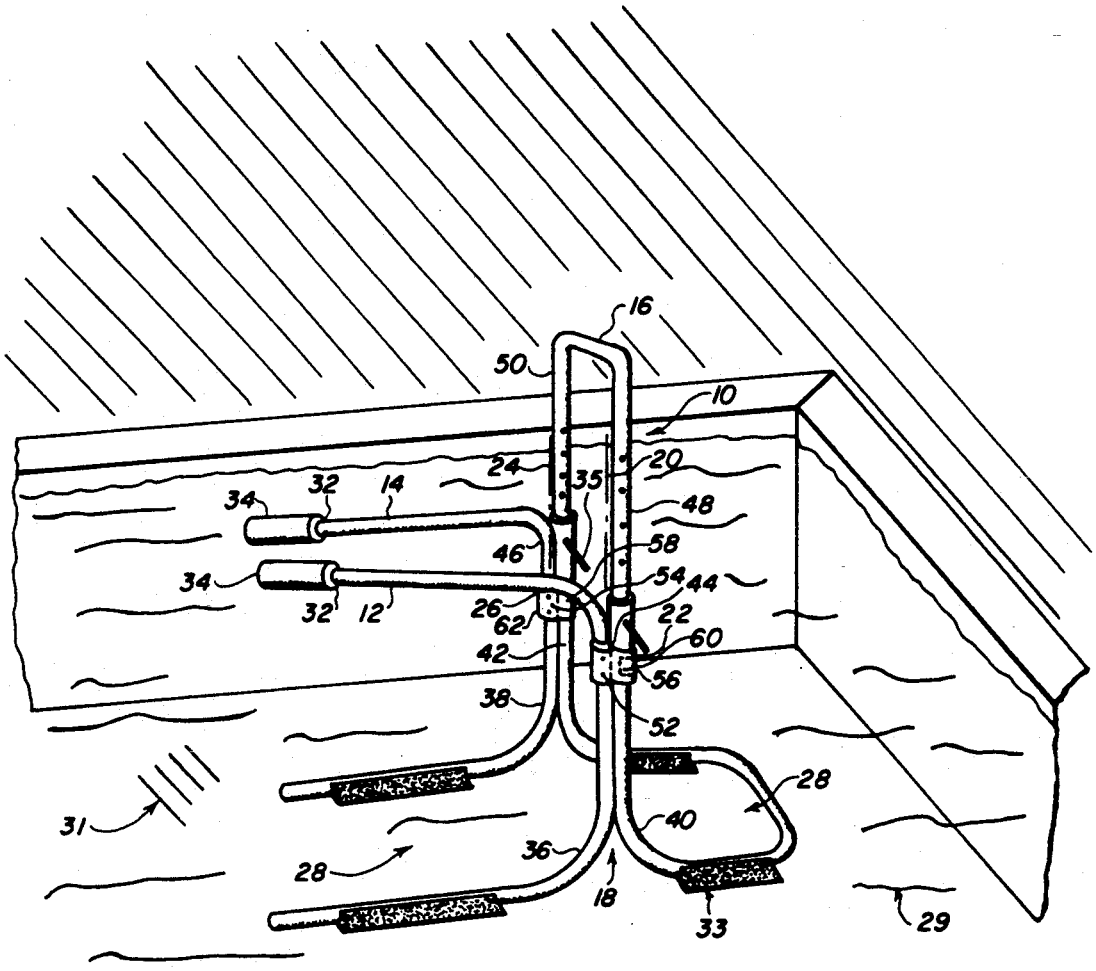
FIG. 1 is a perspective view of the freestanding exercise apparatus.

Referring now to the drawings wherein like reference numerals refer to similar or identical parts throughout the several views, and more specifically to FIG. 1 thereof, there is shown an apparatus 10 for exercising. The exercise apparatus 10 is comprised of a first horizontal member 12 and a second horizontal member 14 in spatial relationship to the first horizontal member 12. A platform 18 supports the first horizontal member 12, and the second horizontal member 14. The platform 18 has a first vertical axis 20 which extends through a first location 22 where the first horizontal member 12 is supported by the platform 18, and a second vertical axis 24 extending through a second location 26 where the second horizontal member 14 is supported by the platform 18. The platform 18 also defines an open region 28 which extends between the first and second horizontal members and below the horizontal cross member. The platform 18 is disposed in a body of water 29 having a bottom 31 on which the platform 18 is disposed such that at least a portion of the user is buoyantly supported during exercise. Preferably, the body of water 29 is a pool.

Preferably, there is also included means for attaching the first horizontal member 12, and the second horizontal member 14 to the platform 18 such that the first and second horizontal members 12, 14 are each able to be fixedly adjusted with respect to height, and the first and second horizontal members 12, 14 are each able to rotate about the first vertical axis 20 and the second vertical axis 24, respectively.

Preferably, there is included a horizontal cross member 16 disposed anteriorly to the first and second members and essentially perpendicular thereto. The cross member 16 is supported by the platform 18. The open region 28 is disposed below the cross member 16 and is uninterrupted by it. The user can freely move between the first and second members 12, 14 to the cross member 16 in the open region 28.

Preferably, there are means 35 for attaching the cross member 16 to the platform 18 such that the cross member 16 is able to be fixedly adjusted with respect to height.

More specifically, the first and second horizontal members 12, 14 are preferably tubular and hollow to facilitate ease of gripping and movement thereof by a user. The first and second horizontal members each have a free end 32 with a handle 34 disposed thereon to aid a user in gripping the free end 32 of the first and second horizontal tubular members 12, 14. The first horizontal member 12 and the second horizontal member 14 are in spatial relationship to each other. They preferably are positioned approximately 2–3 feet apart. The first horizontal member 12 is capable of rotating about a first vertical axis 20 and the second horizontal member 14 is capable of rotating about a second vertical axis 24.

The horizontal cross member 16 is also preferably tubular and hollow to facilitate ease of gripping and adjusting by a user. Ideally, the horizontal cross member 16 should be able to support at least 250 pounds. The horizontal cross member 16 is positioned essentially perpendicular to the essentially parallel first and second horizontal members 12, 14. Preferably, the platform comprises pads 33 for providing enhanced traction between the platform 18 and the bottom 31. Preferably, the pads are comprised of rubber.

The platform 18 which supports the first and second horizontal members 12, 14 and the horizontal cross member 16 preferably has four posts extending vertically therefrom. The first post 36 and second post 38 support the first and second horizontal members 12, 14, respectively. The first and second posts 36, 38 are parallel and disposed on opposite sides of an open region 28. The first vertical axis 20 is defined by the first post 36 and the second vertical axis 24 is defined by the second post 38 with the first and second vertical axes 20, 24 essentially being the longitudinal axes of the first and second posts 36, 38. The third post 40 and fourth post 42 support the horizontal crossing member 16. The third post 40 is parallel to the first post 36 and preferably adjacent thereto, and the fourth post 42 is parallel to the second post 38 and preferably adjacent thereto. The third and fourth posts 40, 42 are disposed on opposite sides of the open region 28.

The four posts are preferably tubular and hollow and have a diameter which allows the flanged end 44 of the first horizontal member 12, the flanged end 46 of the second horizontal member 14, and the first flanged end 48 and second flanged end 50 of the horizontal crossing member 16 to fit into the first, second, third and fourth posts 36, 38, 40, 42, respectively. The first post 36 with the adjacent third post 40 should be at least a distance from the second post 38 with the adjacent fourth post 42 such that a user (not shown) hanging by his arm from the horizontal cross member 16 does not have any swinging movement or lifting movement impeded by the four posts. The distance between the first post 16 and the adjacent third post 40 from the second post 38 and the adjacent fourth post 42 should be between 1 foot and 8 feet and preferably 3 feet. The third and fourth posts 40, 42 which are adjacent to the first and second posts 36, 38, respectively, should be such that the horizontal cross member 16 can easily be raised and lowered independently with respect to the level of the first and second horizontal members 12, 14. This is necessary for the accomplishment of the combined exercises in which both hands are positioned on the horizontal cross member 16; small variations in the height of the horizontal cross member make the sizeable variations in the amount of body which is buoyantly supported during exercise.

The means for attaching the first and second horizontal members to the platform 30 includes first means 52 and second means 54 for attaching the first horizontal member 12 and the second horizontal member 14, respectively, to the first and second posts 36, 38, respectively, such that the first and second horizontal members 12, 14 are each able to be fixedly adjusted with respect to height and the first horizontal member 12 is able to rotate about the first vertical axis 20 and the second horizontal member 24 is able to rotate about the second vertical axis 24. The means for attaching 31 the horizontal cross member 16 to the platform 18 includes a third means 56 and fourth means 58 for attaching the horizontal cross member 16 to the third and fourth posts 40, 42, respectively, such that the horizontal cross member 16 is able to be fixedly adjusted with respect to height. Preferably, the first, second, third and fourth attaching means 52, 54, 56 and 58 are bushings which fit into the hollow posts and are able to receive the flanged ends of the members. The platform 18 with the first and second horizontal members 12, 14 it supports and the horizontal cross member 16 it supports are so positioned that an open region 28 exists extending between the first and second horizontal members 12, 14 and below the horizontal cross member 16. This open region 28 allows the user to quickly move between the first and second horizontal members 12, 14 to the horizontal cross member 16, and also allows two users to use the exercise apparatus 10 at the same time. For instance, one user can be gripping the handles 34 on the first and second horizontal members 12, 14, and a second user can be gripping the horizontal cross member 16.

The first and second horizontal members 12, 14 and the horizontal cross member 16 may be constructed of any material such as metal or plastic so long as they are able to support the upper extremes of the human body weight. The floor platform must be heavy enough to remain stable on the bottom 31 during extreme variations of this type of exercise performed by persons by varying weight and stature.

Figure 2:
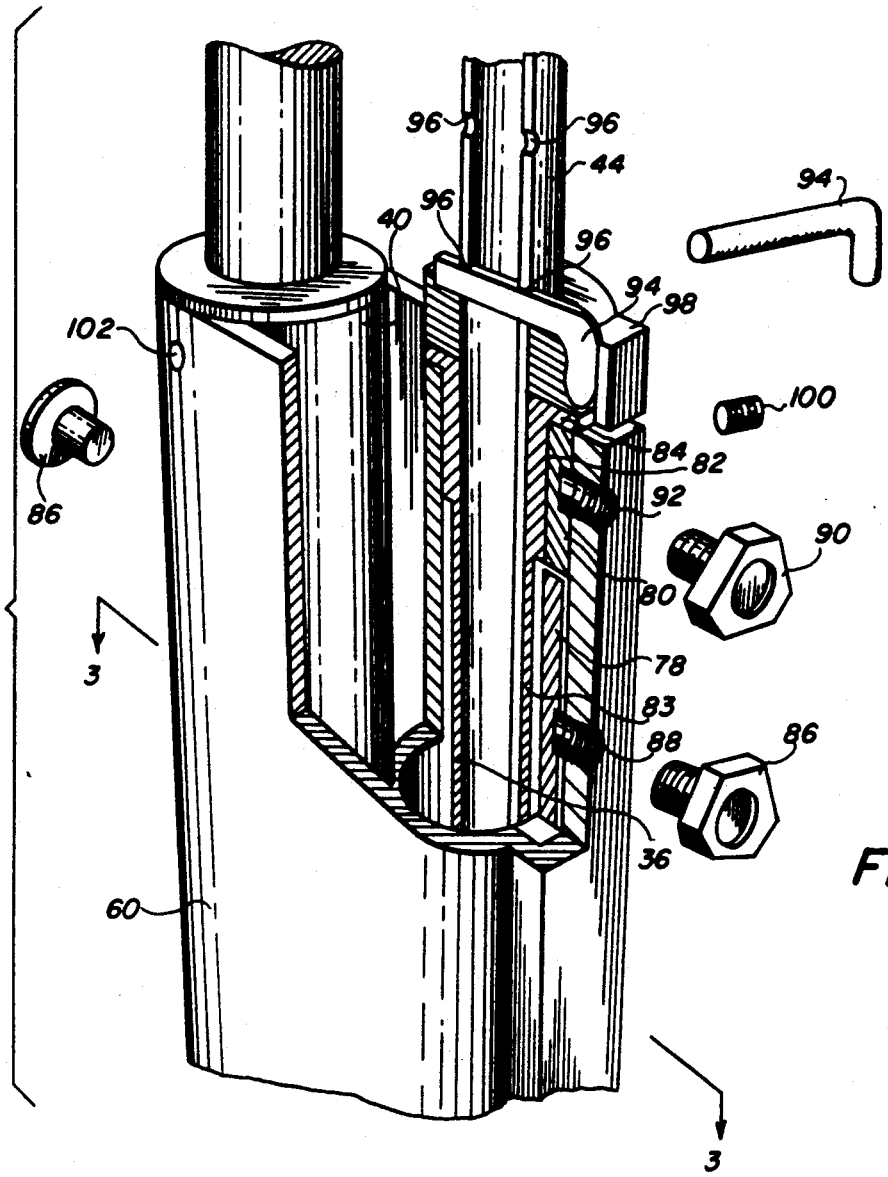
FIG. 2 is a perspective view of the clamp.
Figure 3:
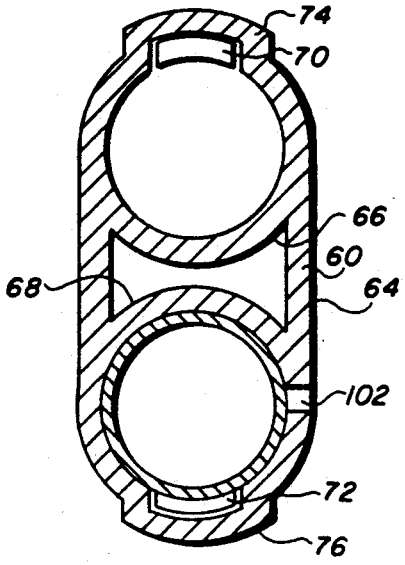
FIG. 3 is a cutaway view of the clamp.

In a preferred embodiment, the first post 36 and the third post 40 are joined together by a first clamp 60, and the second post 38 and the fourth post 42 are joined together by a second clamp 62 as shown in FIG. 2. The first clamp 60 is designed to fit over the first post 36 and the third post 40 to fixedly position them in place. The second clamp 62 is similarly designed to fixedly position second post 38 and fourth post 42 in place. The first clamp 60 and the second clamp 62 are of the same design and each essentially have a common wall 64 that links a first tubular portion 66 and a second tubular portion 68. As shown in FIG. 3, which is an overhead view of the first clamp 60, the first tubular portion 66 and the second tubular portion 68 fit over the two posts they are to hold together. There is a first clamp shoe 70 disposed in the tubular portion at a location at the first end 74 of the first clamp 60. A second clamp shoe 72 is disposed in the second tubular portion 68 at the second end 76 of the clamp 60.

Referring again to FIG. 2, the first and second clamp shoe 70, 72 each have a first clamp section 78 and a second clamp shoe section 80. The first clamp section is for the purpose of anchoring the platform 18 in place. The second clamp shoe section 80 provides friction for resistance during rotation of the first horizontal member 12 of the second horizontal member 14.

A tubular hollow bushing means 82 serves as the first, second, third and fourth attaching means 52, 54, 56, 58 and includes a first bushing section 83 that fits inside each post and a second bushing section 84 that is disposed above each post and connected to the first bushing section 83. The flanged end 44 of the first horizontal member 12 is positioned inside the bushing 82. The second tubular portion 68 of clamp 60 is positioned around the first post 36 and the second section 84 of the bushing means. A first hand knob 86 is threaded through first hole 88 of clamp 60 which is positioned to communicate with the first port 36, fixedly securing clamp 60 to the first post 36 of platform 18. A second hand knob 90 is threaded through second hole 92, which is positioned above the first post 36 and communicates with the second section 84 of bushing means 82, the tightening of the second hand knob 90 causes the desired pressure to be applied against the second section 84 of bushing means 82, consequently causing friction against flanged end 44 of the first horizontal member 12 during rotation thereof.

The bushing means 82 includes a pin 94 positioned in and through a pin hole 96 disposed in the flanged end 44 of the first horizontal member 12. There are several of these pin holes 96 at discrete distances in each of the flanged ends. By placing the pin 94 in a desired pin hole 96 the height of the first or second horizontal member 12, 14 and the height of the horizontal cross member 16 can be chosen. Once the pin 94 is in place in a desired pin hole 96, the flanged end 44 is lowered into the first post 36 until the pin 94 is seated in a pin collar 98 which is also part of the bushing means 82.

Referring to FIG. 3, a set screw 100 is positioned in anchoring hole 102. Anchoring hole 102 penetrates the clamp 60 as well as the second section 84 of the bushing means 82, allowing set screw 100 to hold the bushing means 82 in place so it cannot rotate. When the first horizontal member 12 is rotated about the first vertical axis 20, the flanged end 44 rotates in the first post 36 and bushing means 82 since they are fixed in place. The pin collar 98 is able to rotate with the flanged end 44. The second hand knob 90 is not able to prevent rotation of the flanged end 44, but only to increase or decrease the resistance of the rotation.

The third and fourth posts 40, 42 do not necessarily require the above described post bushing flanged end arrangement, since the horizontal cross bar 16 they support does not rotate. The horizontal cross bar 16 may, for example, be held in place in third and fourth posts 40, 42 by a 94 positioned through a post pin hole 102 in the third or fourth posts 40, 42 and a pin hole 96 of the desired height in the first and second flange ends 48, 50.

Figure 4:
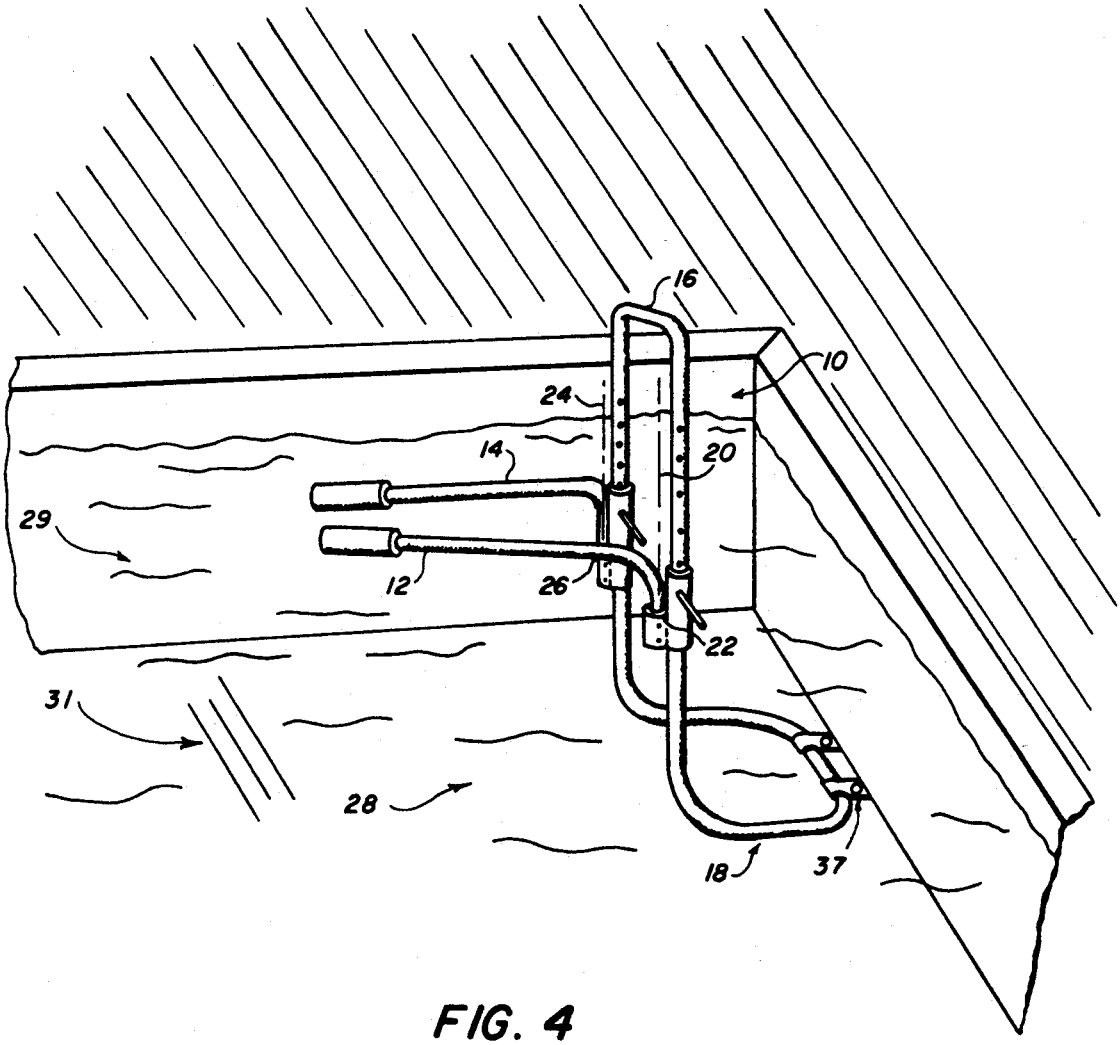
FIG. 4 is a perspective view of the exercise device attached to the bottom with fixture elements.

In a preferred embodiment and as shown in FIG. 4, the platform 18 is not freestanding and there are included means to support the platform 18 on the bottom 31 such that the platform 18 is stable during exercise. Preferably, the platform supporting means 37 is comprised of two fixture elements 39 which are fixedly attached to the bottom 31 and are removably attached to the platform 18.

Because the apparatus 10 is used in a body of fluid, such as water, the above-mentioned components should be made of materials that are water resistant, such as plastics. This is so the water does not effect the apparatus in such a way as to facilitate damage to it, such as rust. Of course, since the apparatus 10 could be removed from a pool of water and used on dry land, the various components could be made interchangeable so different materials can be used for the various components.

When using this apparatus 10, the upper torso becomes participant in the act of weight bearing through reliance by the user on his arms and the first and second horizontal members 12, 14; a task obviously left to the lower extremities in usual bipedal life. The body of water 29 buoyantly supports the user during the various exercise movements. By varying the depth of the body of water, the ratio of the body's air weight to water weight can be adjusted to the user's needs and abilities.

An assortment of movements can be performed on the submerged apparatus 10 for which there is no counterpart on conventional exercise equipment in air. For example, the conventional push-up performed on the first and second members 12 and 14 enjoys the added value of having the feet held in a "high" position, i.e. while floating. Though this is brought about by the physics of buoyancy, the biomechanical uniqueness of the movement becomes immediately apparent, i.e. the back can be held in an extended position without real risk of injury. In effect, the body is raised and lowered from the classical "planche" position, a maneuver impossible for all but a few elite athletes.

The effects of buoyancy may be used to the exercise's advantage in creating challenging tasks when the apparatus 10 is employed while submerged in water. The user must push downward to overcome the effects of buoyancy. Thus, during a partly submerged series of push-ups, the user must pull upward upon the arms in order to force the body downward in water. This is followed by conventional push upward as the body leaves the water and enters the air phase of the movement.

In a like manner, one armed push-ups may be performed readily by most users who are wholly unable to perform these in air. Again, the forces of buoyancy make this possible, since the floating torso is merely elevated on one side by the force of the triceps muscle on that side. Further, all movements are performed more slowly due to the relatively high viscosity of water, the exerciser's attention can be diverted to great range of motion. This in itself is more beneficial and comfortable than conventional static forms of stretching. When such slow whole body movements are performed for long durations, i.e. 5 minutes or more, relatively high heart rates are achievable, and a cardiovascular training effects are likely.

During these combined movements, buoyantly supported by the body of water 29, high levels of work efficiency may become established and may be maintained so long as training continues. The adjustability of the exerciser apparatus 10 facilitates the control of buoyancy and the mechanical "stresses" on particular body parts, by varying the angles through which limbs and trunk act during exercise movements therewith. In particular, the distance between the first and second horizontal members 12, 14, the height of the bars, and the height of the horizontal cross member 16, make for infinite variability of combined movements and buoyancy characteristics. The exercise apparatus 10 and the principles of its use make possible the continuation of beneficial exercise despite certain single or multiple injuries of the body's motor apparatus. This advantage accrues from the inordinate flexibility of the apparatus 10, the diversity of movements it employs, as well as the versatility of the adjustments of the apparatus 10 itself.

The joints of feet, legs, knee and hip, along with the lower spinal segments, are accorded even greater freedom of motion during exercise with the water bound apparatus 10 and this results in certain corresponding training effects. The role of the upper torso and the buoyant effects of the body of water 29 in sharing in the body's support, allows for unique forms of leg action otherwise unavailable to the user. The body thusly supported may remain elevated longer during jumping or hopping movements. This allows sufficient time for leg actions not reproducible when the body's return to earth is influenced irrevocably by the pull of gravity. While the upper torso is retarding the drop to earth the legs can execute movements which involve muscle groups that are to a great extent neglected during conventional exercise of the aerobic type. The abductor and adductor muscles (which move the thighs away from and back to the midline respectively) as well as the hamstring groups gain especial advantage from the use of the apparatus. At the same time, the arms strengthen and gain work capability from these "eccentric" contractions which retard the body's acceleration toward the bottom 31.

Other muscle groups benefit uniquely from the use of the apparatus 10. The abdominal and low back muscles may be trained for strength-endurance effectively. A variety of flexions and extensions of the spine, as well as a wide range of torsions of the trunk may be performed rhythmically with great effect in the course of training the cardiovascular mechanisms of the body. By simply varying its height the horizontal cross member 16 can be used to effectively train a variety of muscle groups. When, for instance, its height is raised, it lies in a position to effectively train the bicep muscles of the arm by merely grasping the bar in the palm-up position during combined body-lifting movements. In each instance, the buoyancy of the water 29 is used to complement the beginner's first efforts, this effort being gradually withdrawn as the arms train.

A variety of movement tempos and ranges of motion are essential to the most beneficial training with the exercise apparatus 10. Though the body weight may be considered a relatively constant variable, the force of buoyancy can be varied substantially, depending on the water's depth 29. These variations can thus emphasize fluid buoyant motion one moment and strength at another, without neglecting the endurance factors essential to the performance of the continuous work that is known to be beneficial to the cardiovascular system.

Aside from the great strength and endurance that is gained with proper use of the apparatus 10 and the method by healthy subjects, the increased range of motion at various joints results in greater suppleness, i.e. flexibility of the body. Many of the movements to be used with the apparatus 10 were specifically designed to enhance these functional capabilities, without neglecting the user's strength-endurance.

For proper understanding of the use of the apparatus 10, it is important to know that combined effects described herein cannot be duplicated by any amount of physical training performed outside of water.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A combined aerobic and strength exercise apparatus for use within a container containing a body of water comprising:

a first horizontal tubular member having a free end and a handle disposed on the free end;

a second horizontal tubular member having a free end and a handle disposed on the free end;

a freestanding platform for supporting the first member and the second member, said platform having a first vertical axis extending through a first location where the first member is supported by the platform, said platform having a second vertical axis extending through a second location where the second member is supported by the platform, said platform defining an open region which extends between the first and second members such that during exercise by user, unobstructed movement can be performed in the open region between the first and second members while the user is gripping the free ends of the first and second members;

means for attaching the first member and the second member to the platform such that the first and second members are each able to be fixedly adjusted with respect to height and the first and second members are able to rotate about the first vertical axis and the second vertical axis, respectively, whereby the user can easily and immediately move between the first and second members to perform corresponding exercises thereon and move a plurality of large muscle groups at the same time and use body weight as primary weight resistance to achieve increased aerobic and strength capacity;

a horizontal tubular cross member disposed anteriorly to the first and second members and essentially perpendicular thereto; said cross member supported by said platform, said open region disposed below said cross member, said the horizontal tubular cross member is able to support at least 250 pounds;

means for attaching the cross member to the platform such that the cross member is able to be fixedly adjusted with respect to height; and wherein the platform has a first and second post extending vertically therefrom for supporting the first and second horizontal members, respectively, said first and second posts being parallel and disposed opposite to each other with the open region therebetween, said first vertical axis being defined by the first post, and said second vertical axis being defined by the second post, and wherein the platform has a third and fourth post extending vertically therefrom for supporting the horizontal cross member, the third post being parallel to the first post and adjacent thereto, and the fourth post being parallel to the second post and adjacent thereto, said third and fourth posts being disposed opposite to each other with the open region therebetween.

2. An exercise apparatus as described in claim 1 wherein the platform comprises pads for providing enhanced traction between the platform and the bottom of the container.

3. An exercise apparatus as described in claim 2 wherein the pads are comprises of rubber.

* * * * *